United States Patent [19]

Stibbe

[11] Patent Number: 4,768,695

[45] Date of Patent: Sep. 6, 1988

[54] AIR BAR FOR PAPER WEB HANDLING APPARATUS AND HAVING AN AIR DISTRIBUTING CHAMBER AND PERFORATED PLATE THEREFOR

[75] Inventor: Paul H. Stibbe, DePere, Wis.

[73] Assignee: Advance Systems, Inc., Oneida, Wis.

[21] Appl. No.: 61,329

[22] Filed: Jun. 11, 1987

[51] Int. Cl.[4] ..... B65H 20/14; F26B 13/20

[52] U.S. Cl. ..... 226/97; 34/156

[58] Field of Search ..... 226/97; 34/156, 160

[56] References Cited

U.S. PATENT DOCUMENTS

| | | | |
|---|---|---|---|
| 3,448,907 | 10/1969 | Otepka et al. | 226/97 |
| 3,496,648 | 2/1970 | Hering, Jr. | 34/156 |
| 3,873,013 | 3/1975 | Stibbe | 226/97 |
| 3,964,656 | 6/1976 | Hella | 34/156 X |
| 4,201,323 | 5/1980 | Stibbe et al. | 226/97 |
| 4,265,384 | 5/1981 | Daane | 226/97 |

*Primary Examiner*—John Petrakes
*Assistant Examiner*—Lynn M. Sohacki
*Attorney, Agent, or Firm*—James E. Nilles

[57] ABSTRACT

An air bar for apparatus for drying a running paper web and floatingly suspending it without contact during the drying process, the air bars being spaced along both the upper and lower surface of the web. The air bars have an air distribution chamber including an easily manufactured and assembled slidable, perforated plate.

7 Claims, 3 Drawing Sheets

AIR BAR FOR PAPER WEB HANDLING APPARATUS AND HAVING AN AIR DISTRIBUTING CHAMBER AND PERFORATED PLATE THEREFOR

BACKGROUND OF THE INVENTION

1. Field of the Invention

This invention relates to an air bar for apparatus for drying and suspending a running paper web in an elongated housing wherein the air bars floatingly guide and suspend the advancing paper web of indeterminate length.

2. BACKGROUND INFORMATION

This invention pertains to paper web handling equipment having air bars for floatingly suspending a web and drying the material such as ink or coating on the web, while not permitting the web to touch any supporting surfaces as the web moves rapidly through the elongated dryer.

This invention is in the nature of an improvement over the paper web handling air bars shown in the following U.S. patents: Stibbe—U.S. Pat. No. 4,265,384, issued May 5, 1981; Stibbe et al—U.S. Pat. No. 4,201,323, issued May 6, 1980; Hella—U.S. Pat. No. 3,964,656 issued June 22, 1976; and Stibbe—U.S. Pat. No. 3,873,013, issued Mar. 25, 1975.

SUMMARY OF THE INVENTION

The present invention provides an air bar for apparatus for drying a running paper web and floatingly suspending it without contact during the drying process. The apparatus has air bars spaced along both the upper and lower surface of the web. The air bars provided by the present invention provide an air distribution chamber including an easily manufactured and assembled slidable, perforated plate.

The present invention provides an air bar of the above type which has a controlled uniform outlet velocity profile from its nozzle slots and center discharge holes without angular flow components.

These and other objects and advantages will appear hereinafter as this disclosure progresses, reference being had to the accompanying drawings.

DESCRIPTION OF A PREFERRED EMBODIMENT

Figure 1:
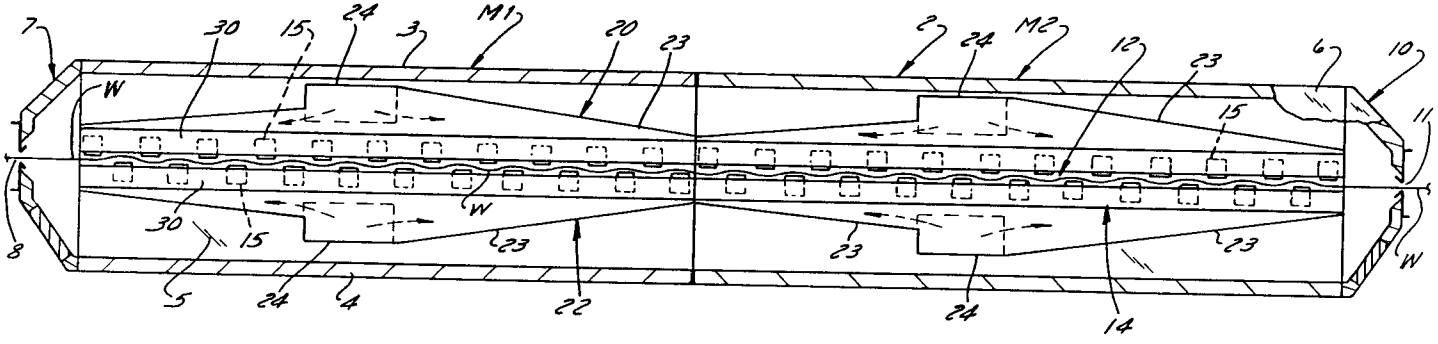
FIG. 1 is a vertical cross-sectional view taken along the length of a web drying apparatus embodying the present invention, the view being generally schematic in nature.

Web drying apparatus for floatingly suspending a running web is shown in FIG. 1 and includes an elongated dryer housing 2 which is enclosed by its insulated top 3, insulated bottom 4, one insulated side 5 and an opposite insulated side 6. An insulated inlet end 7 has a horizontal slot 8 through which the web W enters. The opposite, exit end is formed by the insulated end wall 10 and a corresponding slot 11 therein through which the web exits. In the FIG. 1 showing, two similar housing modules M1 and M2 are joined together end to end. A single module may be used in some installations. The length of a module may vary, for example, from eleven to twenty feet, but a length of twelve to fourteen feet would be average.

The arrangement includes an upper air bar assembly 12 and a lower air bar assembly 14 between which the web W passes. Assemblies 12 and 14 each have a series of air bars 15 located in spaced apart relationship along each of the upper and lower sides of the web and these bars are transversely positioned across the web. It will be noted that the upper air bars are in staggered, spaced relationship along the web with respect to the lower air bars to thereby cause the web to assume a conventional sine wave form when in operation, as shown.

Figure 2:
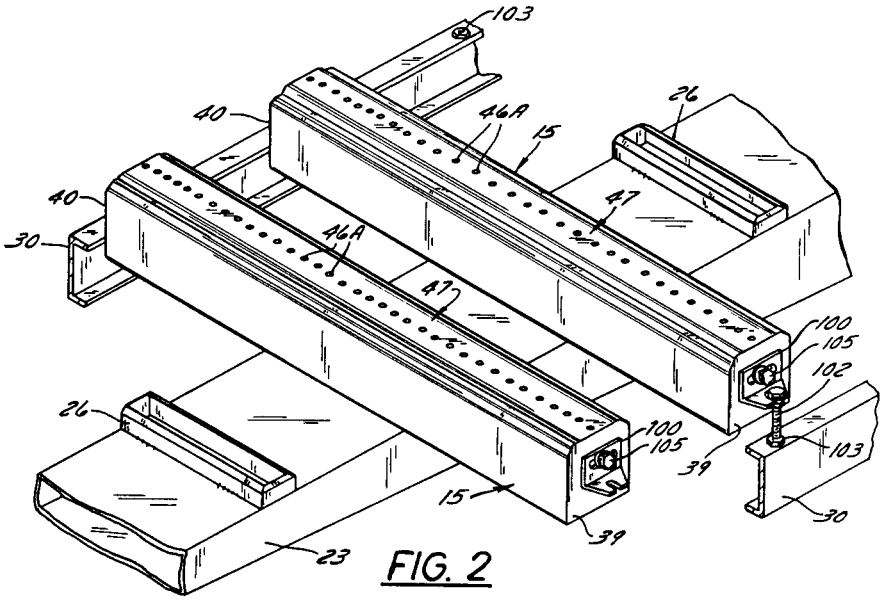
FIG. 2 is a fragmentary, enlarged view of a portion of the apparatus shown in FIG. 1, certain parts being removed for the sake of clarity in the drawings, and showing a pair of air bars as they are mounted on the lower duct means.

An air supply duct means 20 is provided for each module of the upper air bars 15 while a similar air supply duct means 22 is provided for the lower set of air bars 15. These duct means includ the longitudinally extending ducts 23 that extend from the central supply duct 24. The ducts 23 each have a series of air feed necks 26 (FIGS. 2 and 3) extending transversely thereacross and at spaced locations along their length. An air bar 15 is in air receiving communication with each of the necks 26 and thus the air supply ducts furnish pressurized air to each of the air bars for ultimate discharge against the web to floatingly support the latter.

The air supply duct means includes the header frame 30 which is mounted within the housing and acts to support the air supply system.

Figure 3:
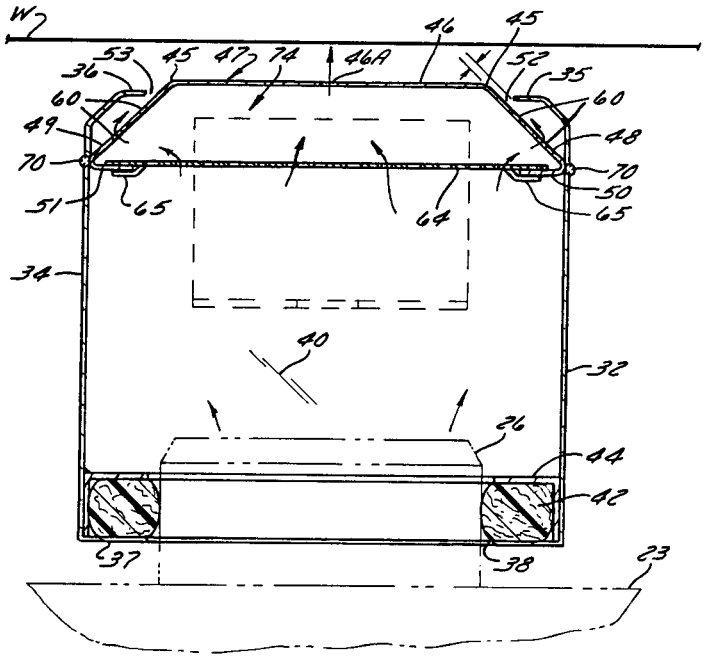
FIG. 3 is a transverse cross-sectional view through one of the air bars shown in FIGS. 1 and 2, but on an enlarged scale.

The air bar shown in detail in FIG. 3 includes the side walls 32, 34 which terminate at their upper ends in the inwardly turned flanges 35, 36, respectively.

The air bars also have end walls 39 and 40 which are welded at the ends of the bars. Adjustment means (FIGS. 2 and 4) are provided on each end of the air bars for adjustably positioning the individual air bars both toward and away from the web and also angularly with respect to the web. This means includes bracket 100, jacking bolt 102, nut 103, and bolt 105.

Figure 4:
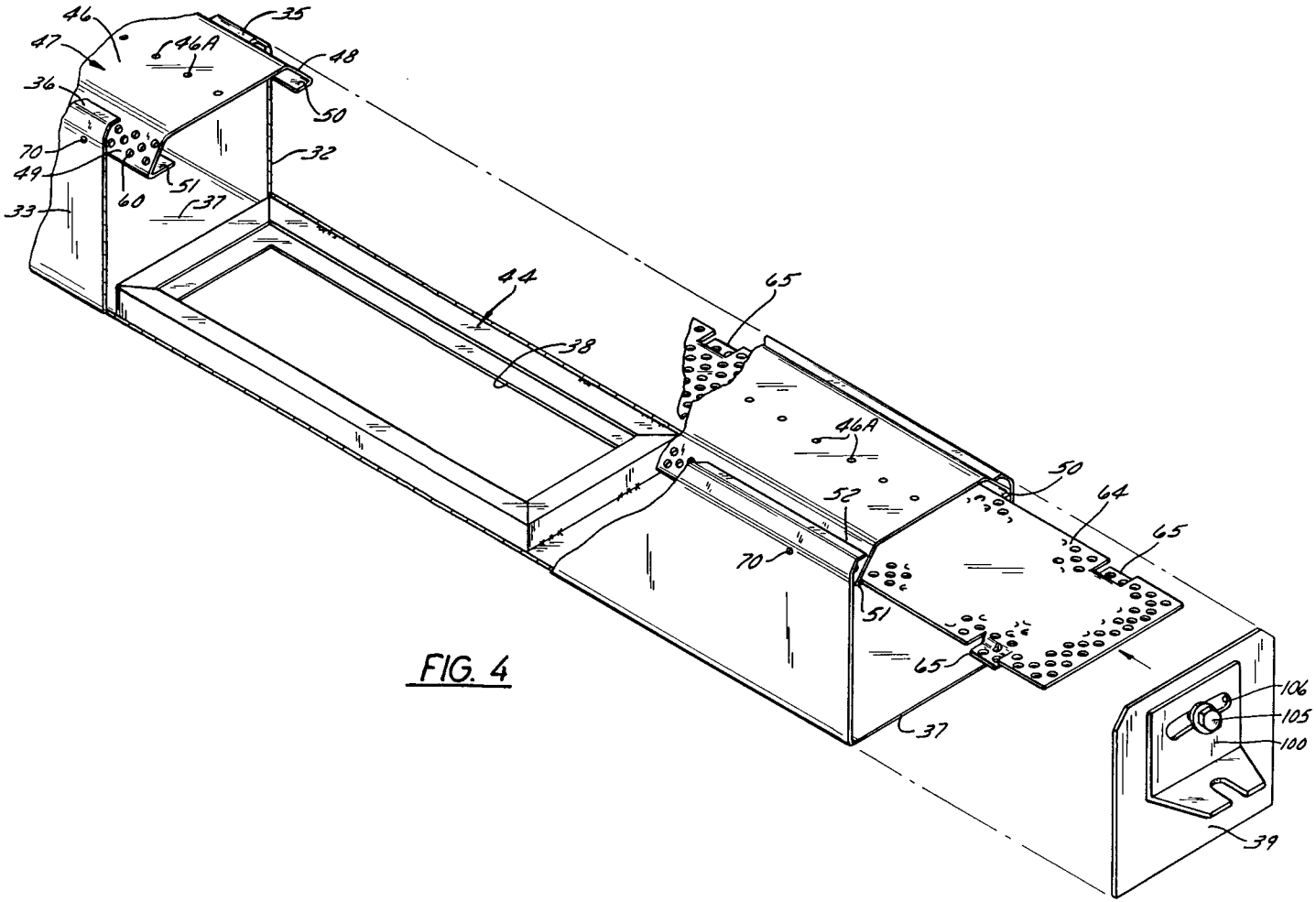
FIG. 4 is a perspective, exploded, fragmentary view of a portion of the air bar shown in the other figures.

The air bars also have a lower wall 37 formed between the side walls and in which a rectangular opening 38 is formed for the purpose of receiving the air feed neck 26 of the duct means. It will be noted that an O-ring type seal 42 is provided in the U-shaped (in cross section) gasket retainer 44 of rectangular form (FIG. 4). The retainer has the open side of its C-shape facing inwardly and is located around the opening 38 in inner wall 37 of the air bar. The seal 42 is located in the C-shape form of the retainer and acts to sealingly embrace the neck 26 of the duct means when the air bar is assembled on the duct means.

The air bar also includes an upper wall 46 (referred to as the air bar face) which is located adjacent the web. This wall 46 may have a center row of air discharge holes 46A for furnishing additional air to the web, if needed.

Thus, the nozzle slots and the center discharge holes from air discharge passages to the web.

The wall or bar face 46 is part of the air distributing member 47 which also includes the inclined walls 48 and 49 and the inner, inwardly turned flanges or lips 50 and 51. The angle at the juncture 45 of walls 46 and inclined walls 48 and 49 is made having as sharp a break in the sheet metal as possible, so as to preclude a Coanda effect of the discharging air. In other words, this prevents the Coanda effect of the air streams trying to follow the sheet metal surfaces around the breaks. This results in stability of the air flow pattern and a more consistent impingement of sharper slot jets onto the web with maintenance of higher heat transfer regardless of web clearance (within limits). The inclined walls 48 and 49 are inclined at about an angle of 45° to the web, that is, to the inner wall 46, as will presently be more fully explained.

The inclined walls 48 and 49 together with the inwardly turned flanges 35 and 36, respectively, form the nozzle slots 52 and 53, respectively. These slots are preferably of a width of 0.085 to 0.090 after gapping.

It will be noted that flanges 35 and 36 lie slightly below the wall 46 in respect to the web, on the order of 0.125 plus or minus 0.015 inches.

The inclined walls 48 and 49 each have a series of small holes 60, as contrasted with conventional openings, disposed along their length to thereby provide a fine scale air turbulence generator. This results in a high heat transfer coefficient.

A perforated plate 64 has a series of depressed tabs 65 (FIGS. 3 and 4) pressed therefrom and spaced along the length of plate 64 so that the perforated plate is slidably engageable along the inwardly turned flanges 50 and 51. The member 47 is rigidly secured within the air bar by means of welding plugs 70 along each of its sides and by means of which it is securely fastened to the side walls 32 and 34 of the air bar. Thus, the tabs 65 and flanges 50 and 51 form guide means for slidably supporting the perforated plate 64. The bifurcations formed by the tabs 65 on the perforated plate provides an easily manufactured and readily assembled perforated distribution plate.

In operation, pressurized air is introduced from the duct supply means into the interior of the air bar via the neck 26 of the ducts and then the air flows through the perforated plate 64 which causes it to be evenly distributed within the equalizing chamber 74 of the air bar and without appreciable cross currents. Then the pressurized air passes through the small apertures 60 of the inclined walls 48 and 49 and through the discharge slot nozzles 52 and 53 against the web, at an angle of about 45°.

The present invention provides an air bar of the above type which has a controlled uniform outlet velocity profile from its nozzle slots and center discharge holes without angular flow components. To accomplish the desired performance the following are the general design parameters.

$$\frac{A_I}{A_O} = 5.0 \quad (1)$$

$$A_L = \frac{A_I}{3} \quad (2)$$

$$W_I = \frac{LG_{AB}}{3} \quad (3)$$

Where:

$A_O$=orifice area of slots 52, 53 and holes 46A

$A_I$=inlet area of neck 26

$A_L$=lateral flow area defined within walls 32, 34, plate 64 and retainer 44

$LG_{AB}$=length of air bar $W_I$=width of inlet neck

Within a given air bar cross section as shown in FIG. 3, the area $A_L$ should be maximized without making the secondary distribution chamber 64 too small. Air entering the tubular air bar 15 via the inlet neck 26 must flow from the inlet outward in both directions to supply air to the orifices 52, 53 and 46A. This flow arrangement can contribute non-uniformity of outlet velocity and angularity in the air issuing from the orifices. The perforated plate 64, when placed as shown in FIG. 3, results in controlling the supply conditions and produces outlet velocity uniformity.

The perforated plate is arranged with 7 rows of ¼" diameter holes on ½" centers for the full length of the air bar. The sizing of the holes is such that they are large enough to be resistant to plugging by airborne particulates, but small enough to control flow angularity therein. The area of the perforations in plate 64 is 3.38 times larger than the orifice areas of 52, 53 and 46A combined. The associated pressure loss in the present system is less than 10 per cent of the nozzle outlet velocity pressure which is reasonable. The velocity profile across the full length of the air bar is uniform but slightly concave in shape which contributes to web centering tendencies from a full array of air bars as shown in FIG. 1.

The constructional design details of the air bar parts, particularly where walls 48 and 49 are plug welded at 70, would be difficult if they terminated at walls 32 and 34; therefore, the inwardly turned flanges 50 and 51 contribute to good manufacture ability. These flanges are integrally formed with tabs 65 on the perforated plate 64 to slidably mount the perforated plate.

Slidably mounting of the plate as above described allows for ease of assembly for manufacture, and also permits freedom of expansion during operation when the temperature rises.

Furthermore, the position of the perforated plate in the position shown in the cross section of FIG. 3, results in attainment of the goals of maximizing area $A_L$ and maintaining adequate area in the secondary distributing chamber 74.

What is claimed as the invention is:

1. An elongated, individually replaceable, hollow air bar having an interior for receiving pressurized air, said bar being for use with web drying apparatus for floatingly suspending a running web while the latter is being dried, said air bar having a pair of slot nozzles for extending along its length with one nozzle adjacent each side thereof, and through which nozzles pressurized air can be directed from the inside of said bar and against a web for drying and floating of the latter; an air distributing member defining an air distributing chamber within said bar and having an outer wall located between said slot nozzles and spaced outwardly therefrom and defining an air bar face between said nozzles to provide an air pressure supporting surface for a web passing thereover, a pair of opposed, inclined and perforated side walls, one adjacent each nozzle, said distributing member also having a perforated inner plate extending along the length of the bar and spaced inwardly from said outer wall and located adjacent and engaged with said inclined side walls, and through which perforated inner plate pressurized air passes from (1) that portion of the interior of said bar which is located on the side of said perforated inner plate which is remote from said chamber, (3) then through said inclined perforated side walls and (4) through said nozzle; and guide means for slidably supporting said perforated plate on the air distributing member whereby said plate can be slid endwise into assembled relationship with said bar.

2. The air bar as described in claim 1 wherein said inclined side walls have inner ends, and said guide means are formed by (1) inwardly turned flanges on said inner ends of said inclined side walls, and (2) tabs pressed in offset relationship from said perforated plate and spaced along the length of said plate.

3. An elongated air bar for use with web drying apparatus for floatingly suspending a running web, said air bar having a pair of slot nozzles for extending along its length with one nozzle adjacent each side thereof, an air distributing member defining an air distributing chamber within said bar and having an outer wall located between said slot nozzles and spaced outwardly therefrom and defining an air bar face between said nozzles to provide an air pressure supporting surface for a web passing thereover, said distributing member also having a pair of opposed and perforated inclined side walls which in part define said chamber, one adjacent each of said slot nozzles, said distributing member also having attached thereto a perforated inner plate extending along the length of the bar and spaced inwardly from said outer wall and located adjacent and engaged with said inclined side walls, so that pressurized air passes from (1) that portion of the interior of said bar which is located at the inner side of said perforated plate (2) through said perforated plate, (3) through said perforated inclined side walls, and (4) to and through said nozzles; said outer wall, said perforated inner plate and said inclined side walls defining said air distributing chamber.

4. The air bar according to claim 3 including guide means for slidably supporting said perforated plate on the air distributing member whereby said plate can be slid endwise into assembled relationship with said bar.

5. The air bar as described in claim 4 wherein said guide means are formed by (1) inwardly turned flanges on the inner ends of said inclined side walls, and (2) tabs pressed in offset relationship from said perforated plate and spaced along the length of said plate.

6. The air bar set forth in claim 4 further characterizing in that the area of the perforations in said plate is about 3.38 times larger than the area of the air discharge passages to the web.

7. The air bar set forth in claim 3 further characterizing in that the area of the perforations in said plate is about 3.38 times larger than the area of the air discharge passages to the web.

* * * * *

UNITED STATES PATENT AND TRADEMARK OFFICE

CERTIFICATE OF CORRECTION

PATENT NO. : 4,768,695

DATED : September 6, 1988

INVENTOR(S) : Paul H. Stibbe

It is certified that error appears in the above-identified patent and that said Letters Patent are hereby corrected as shown below:

In claim 1, line 24, after "chamber," insert

-- (2) through said perforated plate --.

Signed and Sealed this

Twenty-fourth Day of January, 1989

*Attest:*

DONALD J. QUIGG

*Attesting Officer*

*Commissioner of Patents and Trademarks*